US009637937B2

(12) United States Patent
Wallther

(10) Patent No.: US 9,637,937 B2
(45) Date of Patent: May 2, 2017

(54) COUPLING ARRANGEMENT

(75) Inventor: Harry Wallther, Hindas (SE)

(73) Assignee: PLUSEIGHT TECHNOLOGY AB, Hindas (SE)

( * ) Notice: Subject to any disclaimer, the term of this patent is extended or adjusted under 35 U.S.C. 154(b) by 388 days.

(21) Appl. No.: 14/002,855

(22) PCT Filed: Feb. 29, 2012

(86) PCT No.: PCT/SE2012/050229

§ 371 (c)(1),
(2), (4) Date: Sep. 3, 2013

(87) PCT Pub. No.: WO2012/121646

PCT Pub. Date: Sep. 13, 2012

(65) Prior Publication Data

US 2013/0333191 A1 Dec. 19, 2013

(30) Foreign Application Priority Data

Mar. 4, 2011 (SE) ..... 1150199

(51) Int. Cl.
*E04G 7/18* (2006.01)
*E04G 7/14* (2006.01)
*E04G 7/22* (2006.01)

(52) U.S. Cl.
CPC ..... *E04G 7/14* (2013.01); *E04G 7/18* (2013.01); *E04G 7/22* (2013.01);
(Continued)

(58) Field of Classification Search
CPC .... E04G 7/16; E04G 7/22; E04G 7/26; E04G 7/307; E04G 7/14; E04G 7/18;
(Continued)

(56) References Cited

U.S. PATENT DOCUMENTS 2,101,317 A * 12/1937 Lemieux ..... E04G 7/14 403/385
2,165,426 A 7/1939 Fordyce et al.
(Continued)

FOREIGN PATENT DOCUMENTS

AU 553886 B2 7/1986
CA 1234298 A1 * 3/1988 ..... F16B 7/1427
(Continued)

OTHER PUBLICATIONS

Supplementary European Search Report received in European Application No. 12755275.7 (PCT/SE2012050229) dated Jul. 7, 2014.

*Primary Examiner* — Daniel P Stodola
*Assistant Examiner* — Matthew R McMahon
(74) *Attorney, Agent, or Firm* — Knobbe Martens Olson & Bear LLP

(57) ABSTRACT

A mechanical coupling arrangement for a scaffold includes a pole and a mounting collar having an attachment surface to which elongated support members can be attached. A level of radial play between the pole and the mounting collar in a first relative angular position is larger than the level of radial play between the pole and the mounting collar in a second relative angular position. The second relative angular position corresponds to a fastening position of the mounting collar, and the first relative angular position corresponds to an axial sliding position of the mounting collar.

16 Claims, 5 Drawing Sheets

(52) U.S. Cl.
CPC ..... *Y10T 29/49826* (2015.01); *Y10T 403/70* (2015.01); *Y10T 403/7075* (2015.01)

(58) Field of Classification Search
CPC ..... E04G 7/32; F16B 7/1427; Y10T 403/30; Y10T 403/7009; Y10T 403/32501
See application file for complete search history.

(56) References Cited

U.S. PATENT DOCUMENTS 2,949,692 A * 8/1960 Kuhn ..... A63H 33/06 138/177
3,885,648 A * 5/1975 Beziat ..... E04G 1/12 182/178.5
4,248,544 A * 2/1981 McKane ..... E04G 7/02 403/191
4,653,142 A 3/1987 Upton
4,718,787 A * 1/1988 Bahloul ..... E04G 7/308 182/186.8
5,317,855 A * 6/1994 De Leeuw ..... E04G 25/06 248/235
5,407,295 A 4/1995 Kuhl
5,411,113 A * 5/1995 Lubinski ..... E04G 7/22 182/186.7
5,427,468 A * 6/1995 Muellenberg ..... F16D 1/04 403/350
6,305,653 B1 * 10/2001 Oldham ..... F16M 11/00 248/125.8
6,622,442 B2 * 9/2003 Kwon ..... E01D 19/125 403/348
6,688,430 B1 * 2/2004 Wallther ..... E04G 7/307 182/186.7
7,407,337 B2 * 8/2008 Tella ..... F16D 1/072 348/345
8,978,822 B2 * 3/2015 Kreller ..... E04G 1/14 182/113
2005/0281613 A1 12/2005 Tella et al.

FOREIGN PATENT DOCUMENTS

DE 4231320 A1 3/1994
DE 4231333 A1 * 3/1994 ..... F16B 7/1427
EP 0004179 A1 9/1979
WO 81/01448 A1 5/1981
WO 94/07038 A1 3/1994
WO 01/33013 A1 5/2001

* cited by examiner

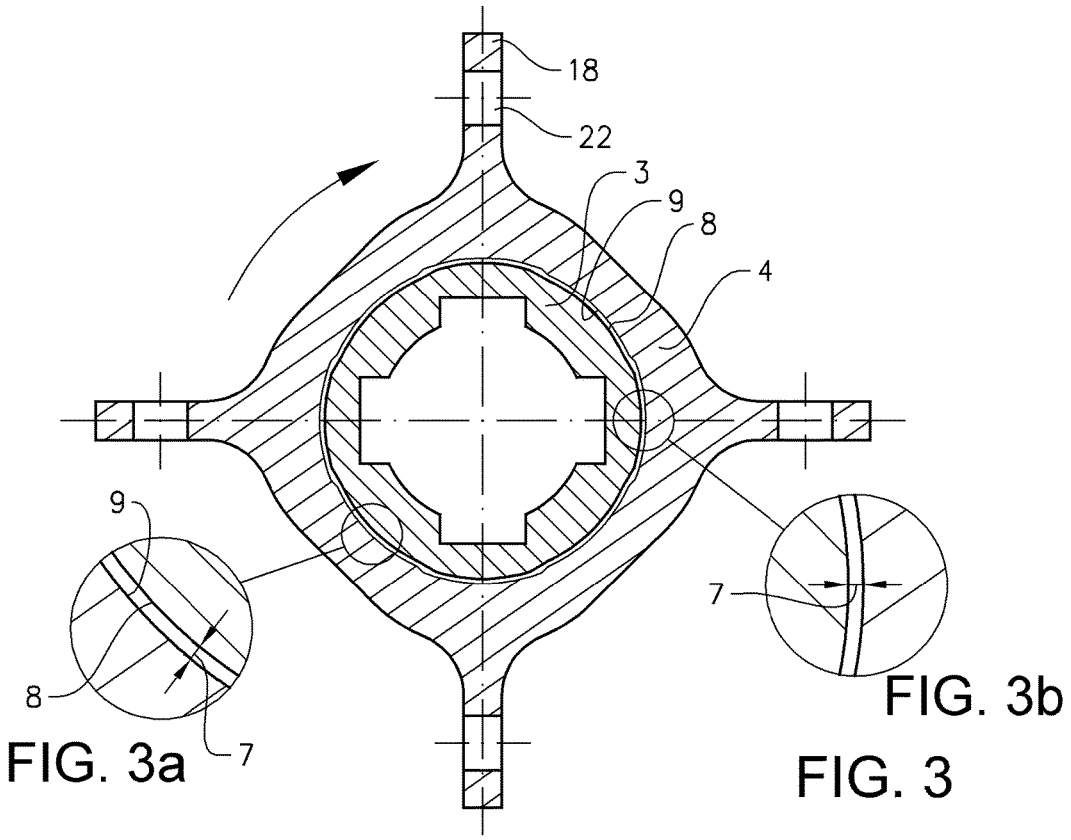
FIG. 3a
FIG. 3b
FIG. 3
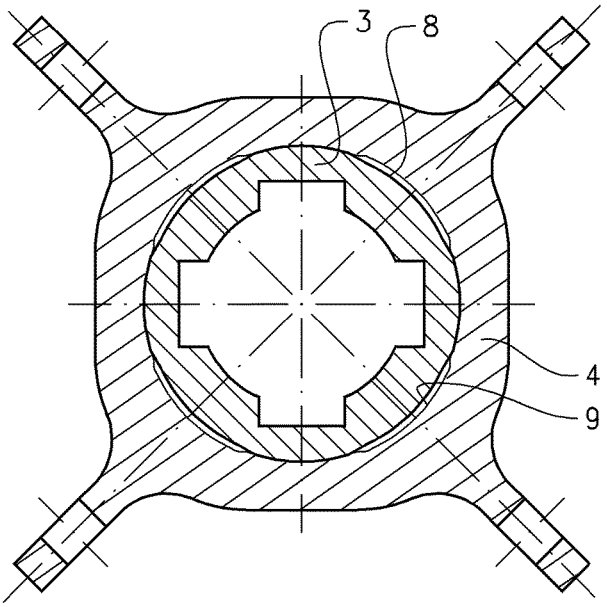
FIG. 4

COUPLING ARRANGEMENT

CROSS-REFERENCE TO RELATED APPLICATIONS

This application is the U.S. National Phase under 35. U.S.C. §371 of International Application PCT/SE2012/050229, filed Feb. 29, 2012, which claims priority to Swedish Application No. 1150199-6, filed Mar. 4, 2011. The disclosures of the above-described applications are hereby incorporated by reference in their entirety.

TECHNICAL FIELD

The present invention relates to a mechanical non-welded coupling arrangement for a scaffold.

BACKGROUND ART

Mounting collars and poles of a scaffold are traditionally made of steel and welded together to form a strong component of a scaffold. Prior art document WO 01/33013 discloses a device for interconnecting scaffolding elements and standards of a scaffolding, wherein the mounting collar is fixedly attached for example by means of a welded joint to the pole. The disadvantage with this design is high weight when scaffold is made of steel, and low load bearing capacity when scaffold is made of aluminium.

There is thus a need for an improved coupling arrangement between a mounting collar and a pole of a scaffold removing the above mentioned disadvantages.

SUMMARY

The object of the present invention is to provide an inventive mechanical coupling arrangement for a scaffold where the previously mentioned problems are partly avoided, wherein the mechanical coupling arrangement comprising a pole and a mounting collar having attachment means to which elongated support members can be attached. This object is achieved by the features of the characterising portion of claim 1, wherein a level of radial play between said pole and said mounting collar in a first relative angular position is larger than the level of radial play between said pole and said mounting collar in a second relative angular position, wherein said second relative angular position corresponds to a fastening position of said mounting collar, and wherein said first relative angular position corresponds to an axial sliding position of said mounting collar.

A coupling arrangement for securing a mounting collar to a pole of an aluminium scaffold based on welding suffer from severely weakening of the material in the heat affected zone, both in short term as well as long term due to fatigue. Hence, the allowed stresses in the heat affected zone are very limited, resulting in a relatively low load bearing capacity. Possible remedies are either to provide the aluminium members of the coupling arrangement with increased thickness of material, or using other materials, such as steel. Both alternatives however lead to increased weight and/or cost of the scaffold. The coupling arrangement according to the invention solves this problem by providing a mechanical coupling arrangement where welding of the mounting collar to the pole is no longer required.

An important aspect in mechanical coupling arrangements, particularly in scaffolds is the amount of mechanical play present in the coupling arrangement during alternating loading thereof. Mechanical play in the coupling arrangement leads to reduced load bearing capacity and reduced stability of the scaffold. The main source of play in mechanical coupling arrangements is normally the difference in exterior diameter of the pole and the interior diameter of the mounting collar. This difference in diameter is absolutely necessary for manufacturing of the pole including the mounting collars, because the mounting collars are initially slidably arranged on the pole in an axial direction to attain the desired axial position thereof along the pole, before fastening of the mounting collars to the pole. Fastening may be realised by means of mechanical fasteners arranged perpendicular to the axial direction of the pole, and oriented towards the centre axis of the pole. Preferably, direct surface contact is accomplished between the internal surface of the mounting collar and external surface of the pole for the purpose of improved stability and load transfer capability. However, due to said inherent play between the mounting collar and pole, said direct surface contact is difficult to achieve, and only possible upon deformation of the mounting collar and/or pole. Such deformation requires high strength mechanical fasteners and/or weak design of mounting collar and pole, neither of which is desired due to increased weight and cost, respectively reduced scaffold stability and load bearing capacity.

Moreover, if said direct surface contact is not realised between the mounting collar and pole, further mechanical play may result due to the difference in diameter between the mechanical fastener and hole for receiving said fastener, and the load transfer between the mounting collar and pole is mainly realised by the mechanical fasteners, which therefore must be correspondingly dimensioned.

The coupling arrangement according to the invention attempts to avoid this problem by providing a mechanical coupling arrangement where level of play between the mounting collar and the pole is reduced in a fastening position of the mounting collar compared with the level of play in an axial sliding position of the mounting collar. One advantage of reduced play is that the internal surface of the mounting collar exhibits direct contact with the exterior surface of the pole at the areas of the fasteners. Direct contact lead to a stronger coupling, because loads from the mounting collar can be transferred directly to the pole. As a consequence, smaller and less expensive fasteners may be used. Furthermore, the level of deformation of the mounting collar and/or pole required to arrive at the desired direct surface contact with the pole is reduced, or even completely eliminated by means of the inventive mechanical coupling arrangement, thus requiring less tension capacity of the fasteners. In all, the fasteners may be made smaller and/or each mounting collar requires fewer fasteners with maintained or reduced stress levels, and the level of play of the scaffold is reduced, whilst providing a strong and lightweight scaffold having relatively high load bearing capacity.

The object of the present invention is additionally to provide an inventive method for coupling a mounting collar to a pole of a scaffold where the previously mentioned problems are partly avoided, wherein said mounting collar having attachment means to which elongated support members can be attached. This object is achieved by the features of the characterising portion of claim 14, which comprises the steps of

- arranging said pole and said mounting collar coaxially side by side in said first relative angular position corresponding to an axial sliding position of said mounting collar,
- sliding said mounting collar onto an external surface of said pole to the desired fastening position, and performing a relative angular movement between said pole and said mounting collar to reach said second relative angular position corresponding to a fastening position of said mounting collar, in which a level of radial play between said pole and said mounting collar is smaller than the level of radial play between said pole and said mounting collar in said first relative angular position.

Further advantages are achieved by implementing one or several of the features of the dependent claims.

The difference in radial play in the first and second relative angular position is a result of that the pole comprises a non-circular cross-sectional external surface, and the mounting collar comprising a non-circular cross-sectional internal surface.

Due to the arrangement where the external surface of said pole has alternating angular sectors of attachment surfaces and sliding surfaces, and the internal surface of said mounting collar has alternating angular sectors of attachment surfaces and sliding surfaces, the attachment surfaces of the pole and mounting collar can be arranged either oppositely or angularly offset from each other, thus creating a sliding mode and a attachment mode of the mechanical coupling arrangement. Hence, this arrangement provides an efficient solution for realising the variable radial play.

By arranging the shape of said attachment surfaces of said pole to correspond to the shape of said attachment surfaces of said mounting collar, an improved fit and force transfer coupling is realised. The shape of said attachment surface of said pole is preferably composed of a single arc-shaped segment, because this leads to a small or eliminated radial play in combination with low required rotation force. Alternatively, the shape of said attachment surface is composed of two arc-shaped segments forming a recess there between for the purpose of providing a self-locking effect at the middle position of the attachment surface, as well as a tactile feed-back for identifying the angular position where the attachment surfaces of the mounting collar and pole are not offset. Each of the two arc-shaped segments would then have a higher curvature than the curvature of the single arc-shaped segment alternative.

With the level of internal surface of the mounting collar in direct contact with the external surface of the pole in a final assembled and fastened state of the mechanical coupling arrangement being at least 25%, and preferably at least 35%, a sufficiently large surface area is in direct contact to provide a strong and reliable coupling arrangement.

The relative angular movement between said pole and said mounting collar required to shift said mechanical coupling arrangement from said first relative angular position to said second relative angular position may be selected within the range of 20°-95°, and more preferably within the range of 25°-65°. These ranges correspond essentially to three, four, or five attachment sectors/sliding sectors on the pole and mounting collar respectively. Less than three attachment sectors leads to a less stable coupling arrangement, and more than five attachment sectors leads to less space available for fastening means. The optimal number of attachment sectors/sliding sectors for each pole and mounting collar is four because this arrangement in a natural way results in four locations with attachment means, thus providing attachment means in four equally distributed directions. Such an arrangement is also advantageous in construction of scaffolds and the like, where poles are arranged in a rectangular lattice.

The pole and/or said mounting collar may have substantially rotational symmetric cross-sectional surface, because this arrangement allows the mounting collar to be mounted onto the pole in several different angular positions, thus simplifying assembly of the mechanical coupling arrangement.

The attachment means may comprise at least one flange provided on said mounting collar as attachment means for external members. Alternatively, at least one hole may be provided within said mounting collar, for example for receiving a connector. According to yet another alternative, the internal surface of the mounting collar may jointly with the external surface of the pole in said second relative angular position define at least one cavity for receiving a hook-shaped connector. This has the advantage of not requiring any formation of holes after extrusion of the parts for attachment means.

Fastening means may be provided for securing said mounting collar to said pole in said second relative angular position, thus providing a stronger and more reliable coupling arrangement. The fastening means may also serve the purpose of eliminating any residual radial play existing in the mechanical coupling arrangement. The fastening means may comprise at least one fastener, which is arranged to penetrate a wall of said mounting collar and engaging a wall of said pole, or a nut behind the wall of the pole. The fastener may be realised by a screw, rivet, huck bolt, pin, or the like.

The level of radial play between the pole and the mounting collar in the second relative angular position may be at least 40% smaller than the level of radial play between the pole and the mounting collar in the first relative angular position, and preferably at least 70% smaller, and more preferably at least 90% smaller. With reduced level of radial play, less deformation of the pole and/or mounting collar is required to reach a play-less mechanical coupling arrangement.

The level of radial play between the pole and the mounting collar in the second relative angular position is within the range of 0-2 mm, and preferably within the range of 0-1 mm, and the level of radial play between the pole and the mounting collar in a first relative angular position is within the range of 1-6 mm, and preferably within the range of 1-3 mm.

BRIEF DESCRIPTION OF THE DRAWINGS

The present invention will now be described in detail with reference to the FIGS., wherein:

FIG. 4. shows the inventive mechanical coupling arrangement in the second relative angular position;

DETAILED DESCRIPTION

In the following two embodiments of the invention are shown and described, simply by way of illustration of two modes of carrying out the invention.

Figure 1:
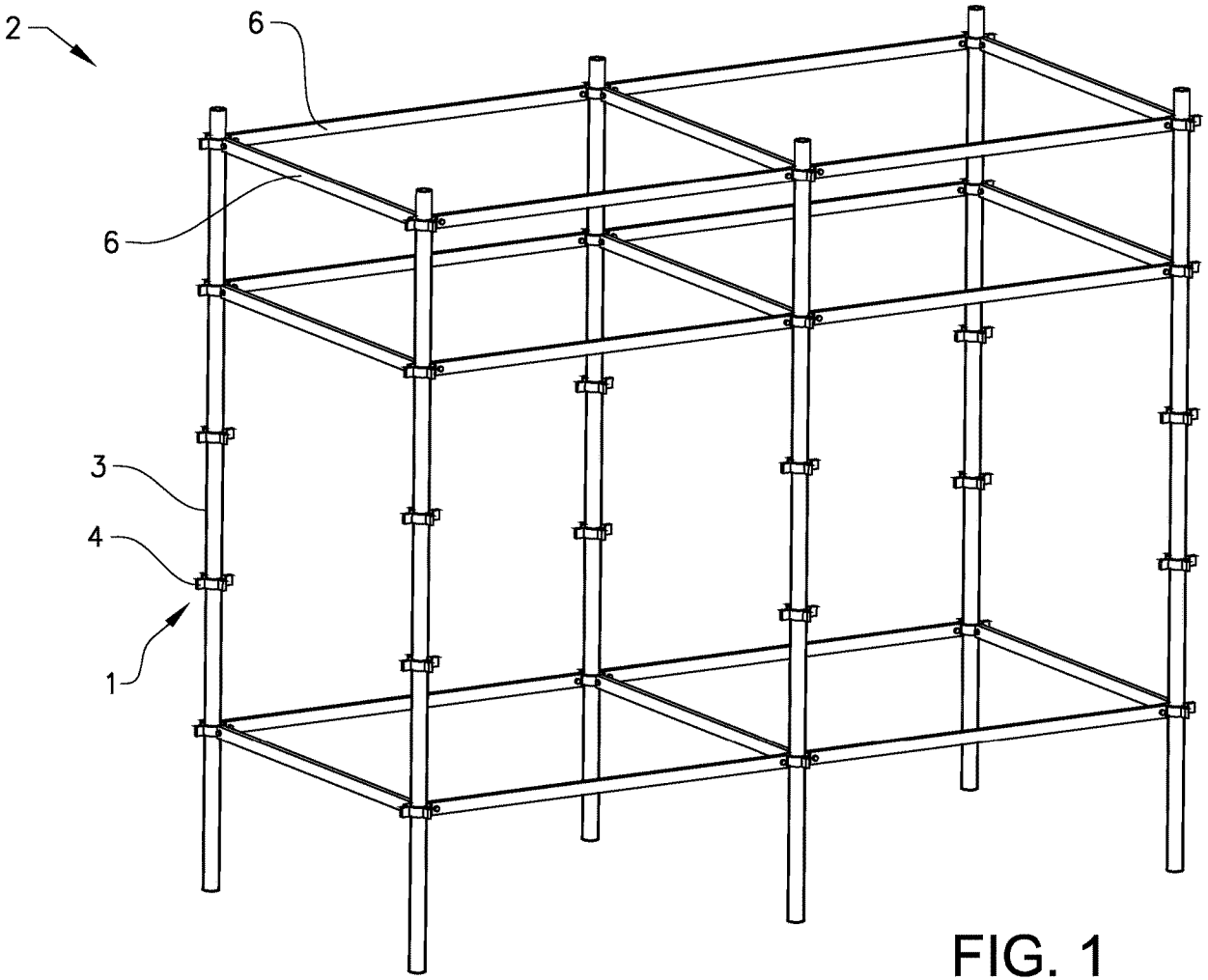
FIG. 1. shows a schematic view of a scaffold comprising the mechanical coupling arrangement of the invention.

FIG. 1 shows schematically an example of a scaffold 2, which comprises vertical poles 3 resting on a supporting surface and elongated horizontal support members 6 for providing scaffold stability and support for other non-showed scaffold parts, such as building platforms. The scaffold 2 can however have a number of various other applications and functions, such as, for example, forming a stage, to support weather shelters for people, vehicles, boats, buildings, to support signs or to form a so-called brace to support cast constructions during building. The mechanical coupling arrangement 1 according to the invention is adapted to mechanically secure mounting collars 4 to the poles 3. The elongated support members 6 are connectable to the mounting collars 4, and the mechanical coupling arrangement 1 connecting the pole 3 with the mounting collar 4 must thus be strong and robust. The mechanical coupling arrangement 1 according to the invention provides an extremely rigid coupling.

Each pole 3 comprises a number of mounting collars 4 arranged over the length of the pole 3 at different levels and enables coupling of the elongated support members 6 at various levels. Apart from horizontal elongate support members 6 which form a supporting part of the scaffold 2 as a whole, it is possible that the mounting collars 4 of the invention is used for the suspension of special scaffolding elements for special purposes, for example for anchoring lifting devices or other aids for carrying out a specific kind of work. In such cases, such scaffolding elements do not need to be elongated or horizontal, and can in certain cases be retained at a single pole 3, and be coupled to one or more mounting collars 4. Several horizontal support members 6 can be coupled to one pole 3 by means of one and the same mounting collar 4.

Figure 2:
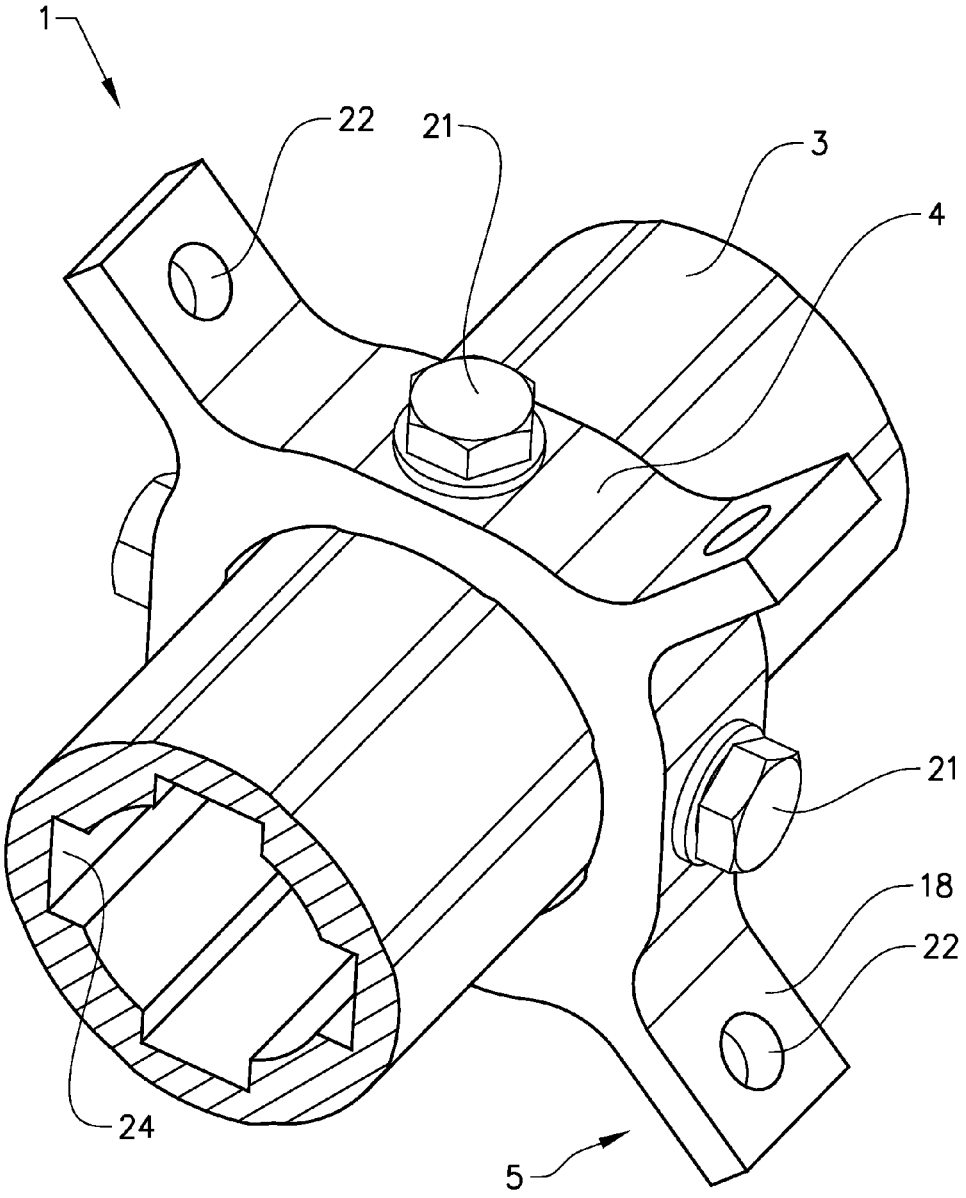
FIG. 2. shows a three-dimensional representation of the mechanical coupling arrangement according to the invention FIG. 3. shows the inventive mechanical coupling arrangement in the first relative angular position and includes detail views FIG. 3*a* which shows the sliding surfaces of the pole facing attachment surfaces of the mounting collar and FIG. 3*b* which shows attachment surfaces of the pole facing the sliding surfaces of the mountain collar.

The construction of a first embodiment of the mechanical coupling arrangement 1 will first be described with reference to FIGS. 2-6. FIG. 2 shows a three-dimensional representation of the mechanical coupling arrangement 1 of the invention. The mechanical coupling arrangement 1 of the scaffold 2 comprises a pole 3 and a mounting collar 4. The mechanical coupling arrangement 1 is formed completely without welding and does therefore not exhibit any weakening of the material in a heat-affected zone. The pole 3 is made of aluminium alloy and formed by extrusion. The pole 3 thus normally has an axially uniform cross-section except for holes formed therein for fasteners, and the exterior surface 8 at regions where the mounting collars 4 are attached is generally smooth, without threads.

The mounting collar 4 is also made of aluminium alloy. The mounting collar 4 is preferably manufactured by firstly extruding a rod, and subsequently cutting the rod in longitudinal segments, thus forming separate mounting collars 4. The mounting collars 4 have generally a smooth internal surface 9, and across-sectional shape of the rod thus corresponds to an axial view of the mounting collar 4. Certain amount of machining may be required after the initial manufacturing steps to obtain the finished parts of the mechanical coupling arrangement 1. For example, holes 22 may be formed in the pole 3 and/or mounting collar 4 for cooperation with fasteners 21, which are used for reliably securing and fastening the mounting collar 4 to the pole 3 at the desired axial and angular position. Holes 22 may also be formed in the attachment means 5 for attaching elongated support members 6 thereto. The attachment means 5 are shaped as circumferentially spaced flanges 18, each provided with a hole 22.

During manufacturing of the complete pole 3 including mounting collars 4, the mounting collars 4 are pushed onto the pole 3 to the desired axial position, and reliably fastened. A certain level of radial play is required between mounting collar 4 and pole 3 to be able to axially slide the mounting collar 4 along the pole 3. Radial play is however not desired at the fastening position of the mounting collar 4 due to reduced load bearing capacity and increased weight of scaffold 2. The solution according to the invention is to provide the mechanical coupling arrangement 1 with a larger level of radial play between the pole 3 and the mounting collar 4 in a first relative angular position than the level of radial play between the pole 3 and the mounting collar 4 in a second relative angular position. The second relative angular position corresponds here to a fastening position of the mounting collar 4, and the first relative angular position corresponds here to an axial sliding position of the mounting collar 4. The difference in radial play occurs thus with the mounting collar 4 arranged at the same axial position on the pole 3, merely by rotating the mounting collar 4 with respect to the pole 3.

The level of radial play is always determined with the pole 3 and mounting collar 4 in a natural, un-deformed state, except where an interference fit is provided between the pole 3 and mounting collar 4 in the second relative angular position.

The difference in radial play in the first and second relative angular position is caused by a pole 3 having a non-circular cross-sectional external surface 8, and a mounting collar 4 having a non-circular cross-sectional internal surface 9. In particular, said difference in radial play is preferably caused by alternating more or less radially protruding angular sectors 10 on the pole 3, and alternating more or less radially protruding angular sectors 10 on the mounting collar 4.

FIG. 3 shows a cross-section of the mechanical coupling arrangement 1 according to the invention in the first relative angular position, in which the mounting collar 4 is slidably arranged on the pole 3 in an axial direction thereof. In the specific embodiment, the cross-sectional shape of the exterior surface 8 of the pole 3 corresponds to the cross-sectional shape of the interior surface 9 of the mounting collar 4, and a peripheral radial gap 7 is defined by the exterior surface 8 of the pole 3 and the interior surface 9 of the mounting collar 4.

FIG. 4 shows a cross-section of the mechanical coupling arrangement 1 according to the invention in the second relative angular position, in which the mounting collar 4 exhibits a smaller level of radial play than in the first relative angular position. To reach the second relative angular position, the mounting collar 4 and pole 3 are rotated with respect to each other, without any relative axial motion. The geometry of the mounting collar 4 and pole 3 determines the angular rotation required to reach the second relative angular position.

The level of radial play between the pole 3 and the mounting collar 4 in the second relative angular position is determined selectively for each application, depending on the actual circumstances, and may be set to at least 40% smaller than the level of radial play between the pole 3 and the mounting collar 4 in a first relative angular position, and preferably at least 70% smaller, and more preferably at least 90% smaller. Optimally, the level of play is completely eliminated in the second relative angular position, but this goal is not always achievable due to for example material constraints and design constraints.

To give a first conception of the parameters involved, the level of radial play between the pole 3 and the mounting collar 4 in the second relative angular position may be within the range of 0-2 mm, and preferably within the range of 0-1 mm, and the level of radial play between the pole 3 and the mounting collar 4 in a first relative angular position is within the range of 1-6 mm, and preferably within the range of 1-3 mm to realize sufficient play for efficient assembly of the manufactured parts.

Figure 5:
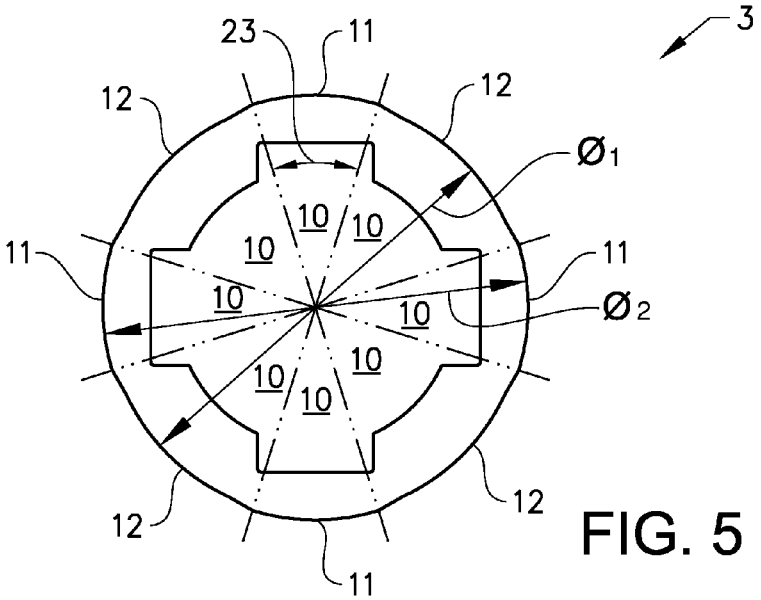
FIG. 5. shows a separate view of the pole according to the invention.
Figure 6:
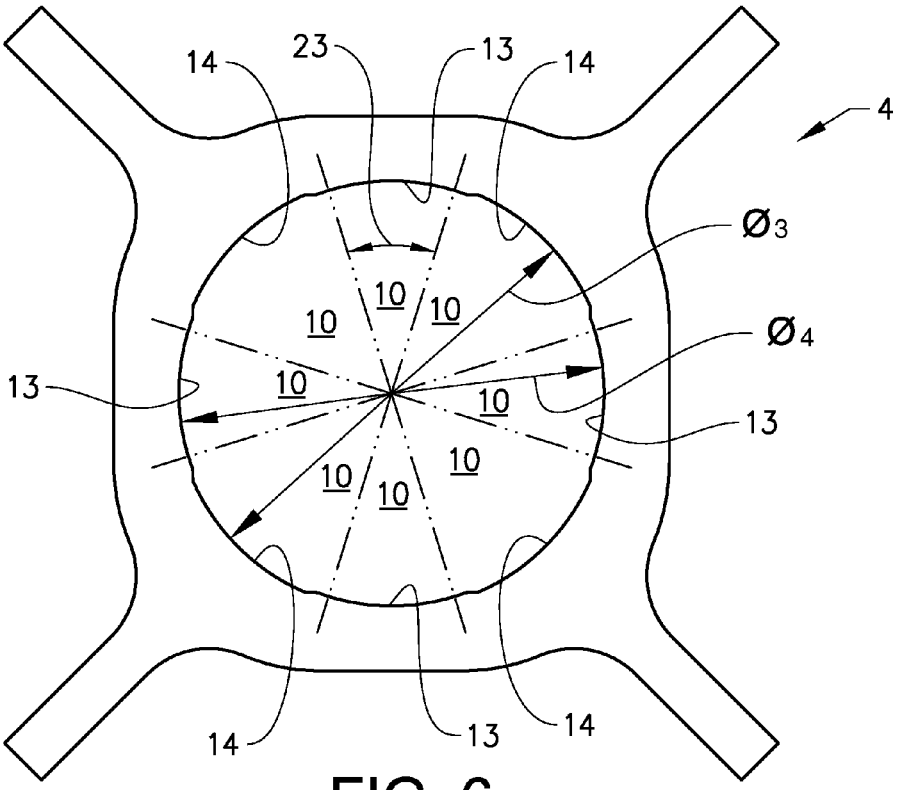
FIG. 6. shows a separate view of the mounting collar according to the invention.

FIG. 5 shows a cross-sectional view of the pole 3 as separate part, and FIG. 6 shows a cross-sectional view of the mounting collar 4 as separate part. The pole 3 and mounting collar 4 according to the disclosed embodiment have substantially rotational symmetric cross-sectional surface. A shape of an angular segment of the cross-sectional surface thus repeats itself after a certain amount of rotation of the pole 3 or mounting collar 4. There might of course be small deviations from the exact rotational symmetry, due to for example holes for fasteners, etc., but the main cross-sectional shape of the pole 3 and mounting collar 4 remains preferably rotational symmetric, because this design allows assembly of the mounting collar in many different angular positions, thus providing a simplified and more economic manufacturing process.

Figure 7:
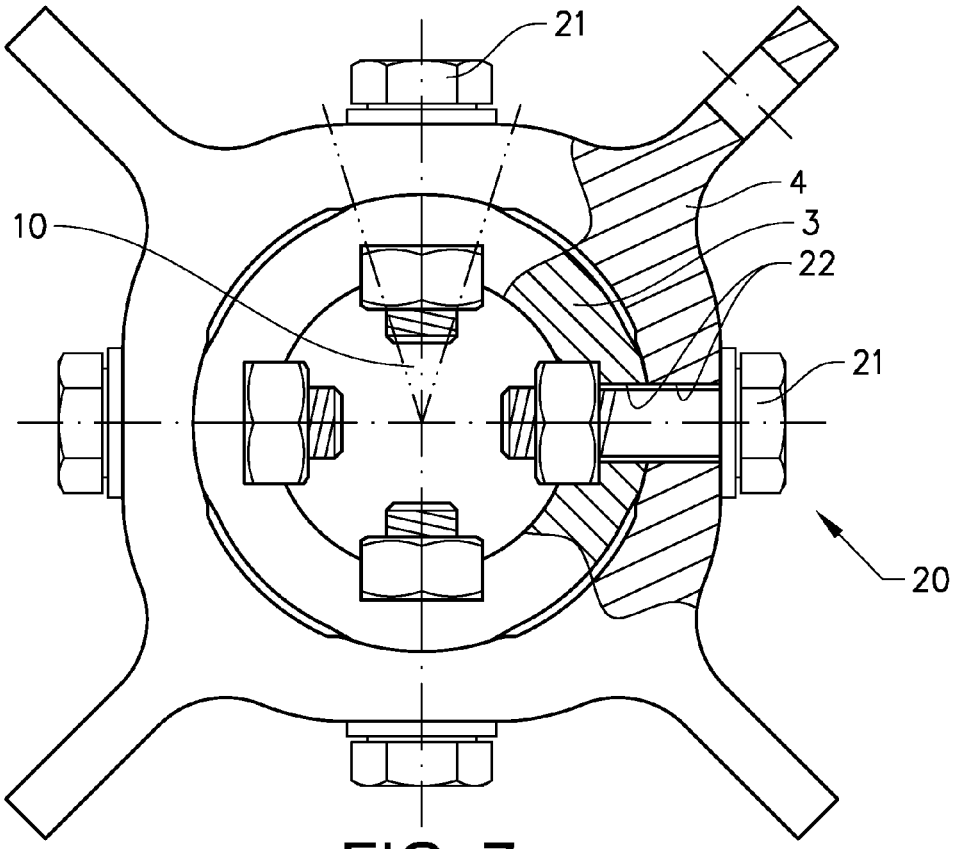
FIG. 7. shows fasteners for securing the mounting collar to the pole according to the invention.

The cross-sectional surface of the pole 3 and mounting collar 4 is divided in angular sectors 10 of alternating attachment sectors and sliding sectors. Each attachment sector of the pole 3 has an external attachment surface 11, each sliding sector of the pole 3 has an external sliding surface 12, each attachment sector of the mounting collar 4 has an internal attachment surface 13, and each sliding sector of the mounting collar has an internal sliding surface 14. A central angle 23 of each of the angular sectors of attachment surfaces 11 of the pole 3, and/or of the attachment surfaces 13 of the mounting collar 4 is preferably larger than 20° , and more preferably larger than 30° for the purpose of providing sufficient direct contact area between the pole and mounting collar in the second relative angular position to realize a reliable and strong coupling arrangement. The attachment sectors 10 are defined by said direct contact area between the pole and mounting collar in the second relative angular position, as illustrated in FIG. 7, and after securing the mounting collar 4 to the pole 3 by means of fastening means 20 if such are foreseen.

In the first relative angular position as shown in FIG. 3, the sliding surfaces 12 of the pole 3 faces the attachment surfaces 13 of the mounting collar 4, and the attachment surfaces 11 of the pole 3 faces the sliding surfaces 14 of the mounting collar 4. In the second relative angular position as shown in FIG. 4, the attachment surfaces 11 of the pole 3 faces the attachment surfaces 13 of the mounting collar 4, and the sliding surfaces 12 of the pole 3 faces the sliding surfaces 14 of the mounting collar 4.

The shape of the attachment surfaces 11 of the pole 3 corresponds to the shape of the attachment surfaces 13 of the mounting collar 4, and the attachment surfaces 11, 13 preferably have essentially identical shape for the purpose of efficient transfer of forces between the pole 3 and mounting collar 4, as well as for providing a potentially play-free coupling thereof without external fasteners 21. The shape of each of the attachment surfaces 11 of the pole 3 is composed of a single circular arc-shaped segment, but may alternatively be composed of the pole 3 is preferably composed of a single circular or single elliptical arc-shaped segments, or two circular or elliptic arc-shaped segments arranged angularly offset from each other, thus forming a recess there between for providing a distinct angular fastening position. Many other shapes of the attachment surface 11 is possible within the scope of the invention, such as a polygonal curve, i.e. composed of piecewise linear curve formed by a series of line segments.

According to the embodiment of the FIG. 2-7, the cross-sectional shape of the sliding surfaces 12 of the pole 3 are angularly spread segments of a circle having diameter $Ø_1$, and the cross-sectional shape of the attachment surfaces 11 of the pole 3 are angularly spread segments of a circle having diameter $Ø_2$, wherein $Ø_1$ is smaller than $Ø_2$. The cross-sectional shape of the sliding surfaces 14 of the mounting collar 4 are angularly spread segments of a circle having diameter $Ø_3$, and the cross-sectional shape of the attachment surfaces 13 of the mounting collar 4 are angularly spread segments of a circle having diameter $Ø_4$, wherein $Ø_4$ is smaller than $Ø_3$. Consequently, a major part of each attachment surface 11 of the pole 3 has an increased radial extension compared with a radial extension of a major part of each sliding surfaces 12 of the pole 3, and a major part of each sliding surface 14 of the mounting collar 4 has a larger radial extension compared with a radial extension of a major part of each attachment surface 13 of the mounting collar 4.

The radial extension of the sliding surfaces 12 of the pole 3 is arranged to be sufficiently limited to provide an adequate radial gap 7 when facing the attachment surface 13 of the mounting collar 4, such that axial sliding of the mounting collar 4 may be performed without problems. Similarly, the radial extension of the sliding surfaces 14 of the mounting collar 4 is arranged to be sufficiently large to provide an adequate radial gap when facing the attachment surface 11 of the pole 3, such that axial sliding of the mounting collar 4 may be performed without problems.

The total annular extension of internal surface 9 of the mounting collar 4 in direct contact with the external surface 8 of the pole 3 in the finally assembled and fastened state of the mechanical coupling arrangement 1 is preferably at least 25% of the total angular extension of the mounting collar 4, and more preferably at least 35% for the purpose of providing sufficient surface area for efficiently transferring loads between the pole 3 and the mounting collar 4 in the second relative angular position. The total angular extension of the mounting collar is 360 degrees. For example, at least 25% of 360 degrees correspond to at least 90 degrees total annular extension of internal surface 9 of the mounting collar 4 in direct contact with the external surface 8 of the pole. With four rotational symmetric attachment surfaces 13, each attachment surface 13 will have at least 22.5 degrees annular extension of internal surface 9 of the mounting collar 4 in direct contact with the external surface 8 of the pole.

The relative angular movement between the pole 3 and the mounting collar 4 required to shift the mechanical coupling arrangement 1 from the first relative angular position to the second relative angular position depends on the geometrical form of the pole 3 and mounting collar 4, and with four equally distributed angular attachment sectors, the required relative angular movement is about 45° With three equally distributed angular sectors, the required relative angular movement is about 60°. Having only two angular attachment sectors leads to less stable mechanical coupling arrangement 1 and is thus less attractive. With five equally distributed angular attachment sectors, the required relative angular movement is about 36°. The required angular movement is thus normally within the range of 20°-95°, preferably within the range of 25°-65°. Embodiments of the invention having unequally distributed angular attachment sectors are of course possible, but have the disadvantage of leading to a partly asymmetric form of the pole 3 and mounting collar 4, thus impairing easy of manufacturing and assembly of the assembled pole 3.

In certain applications of the mechanical coupling arrangement 1, the mere relative rotation of the pole 3 with respect to the mounting collar 4 results in a play-free fastening position of the coupling arrangement 1, and with a certain level of interference fit, which may be sufficient for the specific use. However, in other applications, a small level of play may still exist in the second relative angular position, or the resulting interference fit may not be sufficient for a reliably coupling arrangement 1. Then additional fastening means 20 are required to ensure sufficient direct contact between the mounting collar 4 and pole 3, as well as guaranteeing a strong, robust, reliable and play-free coupling arrangement 1.

FIG. 7 shows the mechanical coupling arrangement according to the invention after having secured the mounting collar 4 to the pole 3 by means of additional fastening means 20, which preferably comprises four threaded fasteners 21 penetrating a wall of the mounting collar 4 and a wall of the pole 3, and subsequently engaging a nut arranged within the hollow pole 3. The internal surface of the pole 3 is preferably provided with axial channels 24 for preventing the nut from rotating during engagement of the threaded fastener 21. Alternatively, the pole 3 may be provided with threaded holes, or the fastener 21 itself is thread-forming. The fastener 21 is preferably formed as a threaded fastener, such as a screw, but the advantages of the invention may alternatively be realised using fastening means formed by rivets, huck bolts, axial pins, or the like.

Figure 8:
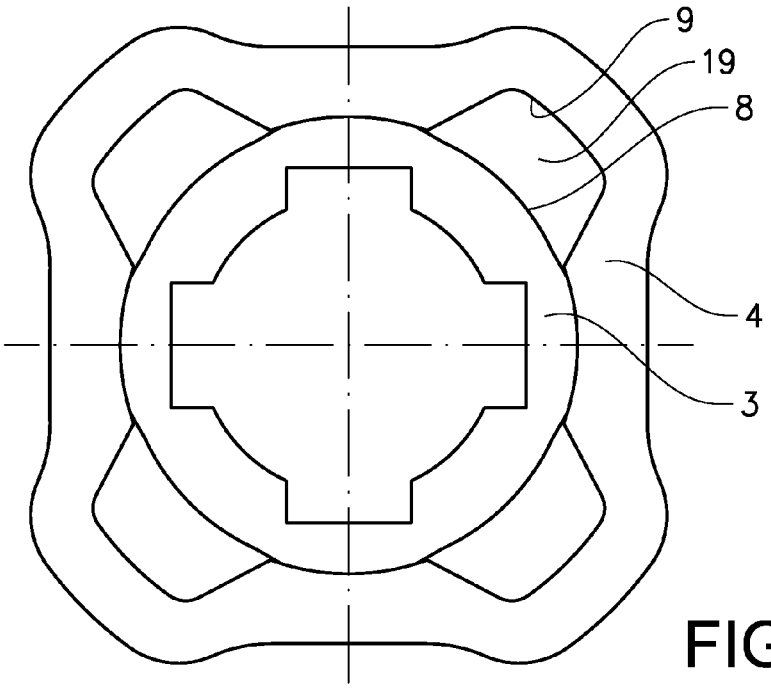
FIG. 8. shows a second embodiment of the attachment means of the mounting collar according to the invention.

The mechanical coupling arrangement 1 according to the invention is provided with attachment means 5 for connecting elongated support members 6 to the assembled pole 3 including the mounting collars 4. The attachment means 5 comprises at least one flange 18 provided on the mounting collar 4, or at least one hole provided within the mounting collar 4 for receiving a connector or fastener. According to a second embodiment of the mechanical coupling arrangement 1 as illustrated in FIG. 8, the shape of the mounting collar 4 is selected such that the internal surface 9 of the mounting collar 4 defines, in the second relative angular position, jointly with the external surface 8 of the pole 3 at least one cavity 19 for receiving a hook-shaped connector. This alternative has the advantage of providing attachment means 5 without further manufacturing steps of the mounting collar 4 after extrusion and cutting of the aluminium profile, from which the mounting collar 4 is formed. The mechanical coupling arrangement 1 in FIG. 8 is shown without additional fastening means 20, but this embodiment may be equally equipped with additional fastening means 20 if required.

The method for assembling and coupling the mounting collar 4 to the pole 3 of a scaffold 2 will now be described in more detail. Firstly, the parts of the mechanical coupling arrangement 1 according to the invention are manufactured. A first aluminium profile forming the pole 3 of the coupling arrangement 1 of the invention is extruded, and subsequently cut in longitudinal segments to attain the desired length. A second aluminium profile having a cross-section corresponding to the cross-section of the mounting collar 4 is extruded, and subsequently cut in longitudinal segments to form individual mounting collars 4. Holes 22 and the like required to finish the attachment means 5 and cooperate with the fastening means 20 are formed in the pole 3 and mounting collar 4.

Then the parts of the mechanical coupling arrangement 1 according to the invention are assembled to form an assembled pole 3 including the desired amount of mounting collars 4, preferably evenly distributed along the length of the pole 3. To arrange a mounting collar 4 on the pole 3, the pole 3 and mounting collar 4 are coaxially arranged side by side, and in the first relative angular position, which corresponds to an axial sliding position of the mounting collar 4. Thereafter, the mounting collar 4 can be pushed onto the pole 3 to the desired fastening position of the mounting collar 4. A certain level of radial play is provided in the first relative angular position, such that the mounting collar 4 can slide on the external surface 8 of the pole 3. Upon having attained the desired axial position, a relative angular movement between the pole 3 and the mounting collar 4 is performed to reach the second relative angular position, which corresponds to a fastening position of the mounting collar 4.

In case a certain radial play still exists in the second relative angular position, or additional coupling strength is required, fastening means 20 are provided to reliably attach the mounting collar 4 to the pole 3. Preferably, the fastening means 20, the mounting collar 4, and the pole 3 are jointly designed to eliminate any eventual residual radial play in the mechanical coupling arrangement 1, for example by means of threaded fasteners 21 pressing the mounting collar 4 against the exterior surface 8 of the pole 3. Eventual deformation of the mounting collar 4 and/or pole 3 is simplified by the fact that only every other angular sector 10 of the mounting collar 4 contacts the pole 3, whilst the remaining angular sectors 10 of the mounting collar 4 and/or pole 3 can support and facilitate the required deformation.

In case the radial play is eliminated in the second relative angular position purely due to the relative rotation of the parts 3, 4, additional fastening means 20 may be provided anyway to increase the strength of the mechanical coupling arrangement 1. In this case, the fastening means 20 does not necessarily have the capacity to radially deform the mounting collar 4 and/or pole 3, and can thus have a different design if desired.

The mechanical coupling arrangement 1 of the invention has been disclosed in terms of a pole 3 and mounting collar 4 of a scaffold, but the mechanical coupling arrangement 1 may be equally applied in many other mechanical constructions where a strong and lightweight mechanical coupling arrangement 1 is required, such as for example space frame structures and supporting beams.

The term fastening position of the mounting collar 4 is considered to define an angular and axial position of the mounting collar 4 with respect to the pole 3 in the finally assembled and fastened arrangement of the mounting collar 4.

The term axial sliding position of the mounting collar 4 is considered to define and angular position with respect to the pole 3 different from the angular position of the mounting collar 3 in said fastening position. Hence, an angular position corresponding to a different relative angular position than the relative angular position of the mounting collar 4 and pole 3 in said fastening position.

The term cross-section is considered to define a section formed by a plane cutting through an object at right angles to an axial direction of that object.

The term elongated support member is considered to encompass all different kinds of support member, such as transverse brace, strut tube; platform support, etc.

The term pole is considered to encompass all different kinds of tubular members, rods, and uprights.

Reference signs mentioned in the claims should not be seen as limiting the extent of the matter protected by the claims, and their sole function is to make claims easier to understand.

As will be realised, the invention is capable of modification in various obvious respects, all without departing from the scope of the appended claims. Accordingly, the drawings and the description thereto are to be regarded as illustrative in nature, and not restrictive.

TABLE OF REFERENCE SIGNS

1 Mechanical coupling arrangement
2 Scaffold
3 Pole
4 Mounting collar
5 Attachment means
6 Support member
7 Radial gap
8 External surface of pole
9 Internal surface of mounting collar
10 Angular sector
11 Attachment surface of pole
12 Sliding surfaces of pole
13 Attachment surface of mounting collar
14 Sliding surfaces of mounting collar
18 Flange
19 Cavity
20 Fastening means
21 Fastener
22 Hole
23 Central angle
24 Channel

What is claimed is:

1. Mechanical coupling arrangement for a scaffold, comprising;

a pole and a mounting collar having an attachment surface to which elongated support members can be attached, said pole being arranged within said mounting collar;

wherein:

said attachment surface is a radially and outwardly protruded part of the mounting collar, a level of radial play between said pole and said mounting collar in a first relative angular position is larger than the level of radial play between said pole and said mounting collar in a second relative angular position, wherein said mounting collar as a whole is rotated about an axis of said pole to move from the first relative angular position to the second relative angular position, said second relative angular position corresponds to a fastening position of said mounting collar relative to said pole, said first relative angular position corresponds to an axial sliding position of said mounting collar relative to said pole, said pole has an external surface having sliding surfaces with a cross-sectional shape of angularly spread segments of a circle having a first diameter, and attachment surfaces with a cross-sectional shape of angularly spread segments of a circle having a second diameter, wherein the first diameter is smaller than the second diameter, and the circle having the first diameter and the circle having the second diameter are concentric around the axis of the pole, said mounting collar has an internal surface having sliding surfaces with a cross-sectional shape of angularly spread segments of a circle having a third diameter, and attachment surfaces with a cross-sectional shape of angularly spread segments of a circle having a fourth diameter, wherein the fourth diameter is smaller than the third diameter, wherein said sliding surfaces of said pole face said attachment surfaces of said mounting collar and said attachment surfaces of said pole face said sliding surfaces of said mounting collar in said first relative angular position, and said attachment surfaces of said pole face said attachment surfaces of said mounting collar and said sliding surfaces of said pole face said sliding surfaces of said mounting collar in said second relative angular position;

at least one fastener is provided securing said mounting collar to said pole in said second relative angular position, and said at least one fastener penetrating a wall of said mounting collar and engaging a wall of said pole in the second relative angular position, wherein said at least one fastener is selected from the group consisting of a screw, rivet, huck bolt, and pin.

2. Mechanical coupling arrangement according to claim 1, wherein said mounting collar is arranged at the same axial position on said pole in said second relative angular position and said first relative angular position.

3. Mechanical coupling arrangement according to claim 1, wherein the shape of said attachment surfaces of said pole corresponds to the shape of said attachment surfaces of said mounting collar, and said shape of said attachment surfaces of said pole is composed of a single arc-shaped segment, or composed of two arc-shaped segments forming a recess there between.

4. Mechanical coupling arrangement according to claim 1, wherein an amount of internal surface of the mounting collar in direct contact with the external surface of the pole in a final assembled and fastened state of the mechanical coupling arrangement is at least 25%.

5. Mechanical coupling arrangement according to claim 1, wherein the relative angular movement between said pole and said mounting collar required to shift said mechanical coupling arrangement from said first relative angular position to said second relative angular position is within the range of 20°-95°.

6. Mechanical coupling arrangement according to claim 1, wherein said pole and/or said mounting collar comprise/comprises substantially rotational symmetric cross-sectional surface.

7. Mechanical coupling arrangement according to claim 1, wherein said radially and outwardly protruded part forms a flange, or at least one hole provided within said mounting collar for receiving a connector, or the internal surface of the mounting collar corresponding to the radially and outwardly projected part jointly with the external surface of the pole in said second relative angular position define at least one cavity for receiving a hook-shaped connector.

8. Mechanical coupling arrangement according to claim 1, wherein the level of radial play between the pole and the mounting collar in the second relative angular position is at least 40% smaller than the level of radial play between the pole and the mounting collar in the first relative angular position.

9. Mechanical coupling arrangement according to claim 1, wherein an amount of internal surface of the mounting collar in direct contact with the external surface of the pole in a final assembled and fastened state of the mechanical coupling arrangement is at least 35%.

10. Mechanical coupling arrangement according to claim 1, wherein the relative angular movement between said pole and said mounting collar required to shift said mechanical coupling arrangement from said first relative angular position to said second relative angular position is within the range of 20°-65°.

11. Mechanical coupling arrangement according to claim 1, wherein the level of radial play between the pole and the mounting collar in the second relative angular position is at least 70% smaller than the level of radial play between the pole and the mounting collar in the first relative angular position.

12. Mechanical coupling arrangement according to claim 1, wherein the level of radial play between the pole and the mounting collar in the second relative angular position is at least 90% smaller than the level of radial play between the pole and the mounting collar in the first relative angular position.

13. Mechanical coupling arrangement according to claim 1, wherein said at least one fastener penetrates a wall of the mounting collar and a wall of the pole.

14. Mechanical coupling arrangement according to claim 1, wherein:

the pole is a hollow pole, said at least one fastener is a threaded fastener penetrating a wall of the mounting collar and a wall of the hollow pole, and engaging a nut arranged within the hollow pole, an internal surface of the hollow pole is provided with at least one axial channel, and said nut is located in said at least one axial channel for preventing said nut from rotating during engagement of said at least one threaded fastener.

15. Mechanical coupling arrangement according to claim 1, wherein said at least one fastener is a threaded fastener penetrating a wall of the mounting collar and a wall of the pole, and that said pole is provided with threaded holes, or the fastener itself is thread-forming.

16. Scaffold comprising a pole and a mounting collar fastened to said pole, wherein said mounting collar is fastened to said pole by a mechanical coupling arrangement according to claim 1.

* * * * *